US006925032B2

(12) United States Patent
Willemin et al.

(10) Patent No.: US 6,925,032 B2
(45) Date of Patent: Aug. 2, 2005

(54) TIMEPIECE WITH A DATE MECHANISM COMPRISING TWO SUPERPOSED DATE RINGS

(75) Inventors: Roger Willemin, Grenchen (CH); Roger Metzger, Aarau (CH); Marco Bettelini, Preles (CH)

(73) Assignee: ETA SA Manufacture Horlogère Suisse, Grenchen (CH)

( * ) Notice: Subject to any disclaimer, the term of this patent is extended or adjusted under 35 U.S.C. 154(b) by 0 days.

(21) Appl. No.: 10/992,695

(22) Filed: Nov. 22, 2004

(65) Prior Publication Data

US 2005/0111303 A1 May 26, 2005

(30) Foreign Application Priority Data

Nov. 26, 2003 (EP) ..... 03027146

(51) Int. Cl.[7] ..... G04B 19/24
(52) U.S. Cl. ..... 368/28; 368/35; 368/37
(58) Field of Search ..... 368/28, 34–38

(56) References Cited

U.S. PATENT DOCUMENTS

| | | | | |
|---|---|---|---|---|
| 4,257,113 | A * | 3/1981 | Meister et al. | 368/35 |
| 6,711,100 | B2 * | 3/2004 | Rochat et al. | 368/35 |
| 6,735,151 | B2 * | 5/2004 | Triponez | 368/28 |
| 6,738,316 | B2 * | 5/2004 | Gabathuler et al. | 368/28 |

FOREIGN PATENT DOCUMENTS

| | | |
|---|---|---|
| CH | 660 941 A | 6/1987 |
| DE | 20 36 464 A | 2/1972 |
| DE | 198 45 539 A | 4/2000 |
| EP | 1 152 303 A | 11/2001 |
| GB | 957 031 A | 5/1964 |

OTHER PUBLICATIONS

European Search Report, completed Jun. 16, 2004.

* cited by examiner

*Primary Examiner*—Vit W. Miska
(74) *Attorney, Agent, or Firm*—Griffin & Szipl, P.C.

(57) ABSTRACT

Date mechanism for a timepiece such as a wristwatch including two superposed respectively upper (4) and lower (6) date rings, whose surface is divided into a plurality of sectors, the upper ring (4) including sixteen sectors, fifteen of which respectively bear fifteen successive markings of a cycle of 31 positions, and the sixteenth of which is an extra sector having an open or transparent aperture (8), whereas the lower ring (6) includes seventeen sectors, sixteen of which bear respectively the other sixteen markings of the cycle of 31 positions, and the seventeenth of which is an extra sector, each of said rings (4, 6) cooperating with drive means such that the markings of the lower ring appear successively in a display zone (30), the date mechanism being wherein each ring (4, 6) includes two peripheral toothings extending along two stepped, respectively upper and lower rows, the teeth (10, 12) of the upper and lower rows of the upper ring (4) being superposed, whereas the teeth (18, 20) of the upper and lower rows of the lower ring (6) are staggered, one location (14, 16; 24, 26) of each of the toothings of the upper (4) and lower (6) rings being tooth free, and in that said date mechanism further includes a correction device, the position of the drive means with respect to the upper and lower toothings of the respectively upper (4) and lower (6) rings, and the position of the correction mechanism with respect to the lower and upper toothings of the respectively upper (4) and lower (6) rings being such that when the upper ring (4) has its extra sector at the location of said display zone (30), the drive means and the correction device are located respectively opposite the tooth free location (14, 16) of the toothing of the upper row and that of the lower row of the upper ring, and vice versa.

7 Claims, 8 Drawing Sheets

TIMEPIECE WITH A DATE MECHANISM COMPRISING TWO SUPERPOSED DATE RINGS

This application claims priority from European Patent Application No. 03027146.4 filed Nov. 26, 2003, the entire disclosure of which is incorporated herein by reference.

The present invention concerns a large date mechanism including two, respectively upper and lower, superposed date rings, one of which carries fifteen successive markings of a cycle of 31 positions, whereas the other carries the other sixteen markings.

Cyclical counting and display devices with an aperture used in calendar timepieces for displaying the date are already known. Usually, the analogue display of the date is conventionally made using a date ring which comprises 31 sectors bearing the markings from 1 to 31. However, such a device has the drawback of only offering one field for each sector, whose dimensions correspond to a $31^{st}$ of the circumference of the ring. In particular in wristwatches of small format, the dimensions of said field are insufficient to allow a date display that is easily readable. The need for a device allowing a "large date" to be displayed on a much larger field than a $31^{st}$ of a circumference has thus been felt.

A first solution to this problem was provided by Swiss Patent Application No CH 660 941 in the name of Brandi, the purpose of which is to provide a cyclical counting and display device with an aperture for a watch calendar which, while being purely mechanical and of simple configuration, enables the date indication to have a large format, at least approximately twice that of a $31^{st}$ of a circumference.

Thus, the Brandi Patent discloses a date mechanism mainly comprising an upper date ring of sixteen sectors, superposed on a lower ring comprising seventeen sectors. On fifteen of its sectors the upper ring bears the markings "17" to "31", whereas the last sector is provided with an aperture. On sixteen of its sectors the lower ring includes the markings "1" to "16", whereas the last sector is free of any marking. The inner circumference of the two rings includes teeth, a place for the upper ring and a place for the lower ring being free of teeth. A date drive finger, conventionally making one revolution every twenty-four hours, drives the date rings in a conventional manner, by acting on their teeth. The position of the drive finger with respect to the toothing of the rings is such that, when a ring has its free position (aperture for the upper ring and sector free of marking for the lower ring) at the watch display location, the drive finger is located facing the tooth free position of the ring concerned.

The Brandi Patent provides a date mechanism for a timepiece that advantageously enables the date indication to be given a large format, substantially twice that of a conventional date mechanism. This date mechanism is driven by a drive finger, which makes one revolution every twenty-four hours and which drives the date rings by acting on their teeth. However, no correction device is provided for quickly altering the indication provided by the date mechanism. Moreover, it raises a problem as regards the positioning of the date rings. Indeed, in accordance with the Brandi Patent, two jumper-effect stopping devices act respectively on the teeth of the upper ring and on the teeth of the lower ring. However, given that one location on the toothing of each of said rings has no teeth, these jumpers have to have dual tips and press between the points of three successive teeth. These jumpers must consequently be of large dimensions and are thus bulky. Moreover, the mechanical features of the hold exerted by the jumpers on the two date rings are different depending upon whether the missing tooth is in the first, second or third position as regards said jumpers. A compromise thus has to be found that guarantees that, whatever the position of the missing tooth, the jumpers ensures a satisfactory positioning of the ring concerned. Such jumpers are thus difficult to obtain.

It is an object of the present invention to overcome the aforementioned drawbacks, in addition to others, by providing a date mechanism enabling the date indication to be given a large format, this mechanism including two superposed, respectively upper and lower, date rings, one of which bears fifteen successive markings of a cycle of 31 positions, whereas the other bears the other sixteen markings, a quick correction device for quickly altering the indication provided by the date mechanism.

It is another object of the present invention to provide a date mechanism of the aforementioned type including a jumper-effect stopping device for positioning the two rings properly.

The present invention thus concerns a date mechanism for a timepiece such as a wristwatch including two superposed, respectively upper and lower, date rings, whose surface is divided into a plurality of sectors, the upper ring including sixteen sectors, fifteen of which respectively bear fifteen successive markings of a cycle of 31 positions, and the sixteenth of which is an extra sector having an open or transparent aperture, whereas the lower ring includes seventeen sectors, sixteen of which respectively bear the other sixteen markings of the cycle of 31 positions and the seventeenth of which is an extra sector, each of these rings cooperating with drive means such that the markings of the lower ring appear successively in a display zone through the aperture, the upper ring remaining immobile, and such that since the lower ring is immobile, the markings of the upper ring then successively appear in the display zone, the upper ring covering the markings of the lower ring, the date mechanism being characterised in that each ring includes two peripheral toothings each made of a succession of regularly spaced teeth, these peripheral toothings extending along two stepped, respectively upper and lower rows, the teeth of the upper and lower rows of the upper ring being superposed, whereas the teeth of the upper and lower rows of the lower ring are staggered, one location of each of the toothings of the upper and lower rings being tooth free, and in that said date mechanism further includes a correction device for altering the indication provided by the date mechanism, the position of the drive means with respect to the upper and lower toothings of the respectively upper and lower rings, and the position of the correction mechanism with respect to the lower and upper toothings of the respectively upper and lower rings being such that when the upper ring has its extra sector at the location of said display zone, the drive means and the correction mechanism are respectively opposite the tooth free location of the toothing of the upper row and that of the lower row of the upper ring, and when the lower ring has its extra sector at the location of said display zone, the drive means and the correction device are respectively opposite the tooth free location of the toothing of the lower row and that of the upper row of the lower ring.

Owing to these features, the present invention provides a date mechanism including two superposed date rings and a quick correction device for quickly altering the information provided by the date mechanism. Advantageously, when one of the rings has its extra sector in the display zone, the correction device is opposite the tooth free location of the toothing of said ring. Consequently, the correction device can only act on the other ring, thus preventing any risk of disturbing the date mechanism.

According to another feature of the invention, the correction device includes a sliding pinion. The sliding pinion only meshes with the toothings of the date rings when it is set in motion by the user by means of a correction stem.

According to yet another feature of the invention, the date mechanism includes jumper-effect stopping means, the lower date ring including an additional toothing located under the lower toothing of said ring and whose teeth are arranged to coincide with those of said lower toothing. Owing to these features, the jumper-effect stopping device is simple to manufacture and enables the two date rings to be properly positioned. In fact, unlike the prior art, where, because of the fact that one location of the toothing of each of the date rings was tooth free, the jumpers had to have a dual tip and press between the tips of three successive teeth, the jumpers according to the invention are constantly housed between two successive teeth of one or other of the toothings of a given ring, such that they remain meshed with the date ring concerned, even during passage of the missing tooth. The jumpers according to the invention thus end conventionally in two inclined planes which press between the tips of two immediately successive teeth to keep the date rings in the desired position. These jumpers are thus of conventional design and exert a holding force of constant intensity on the date rings, whatever the position of said rings.

Other features and advantages of the present invention will appear more clearly from the following detailed description of an embodiment of the date mechanism according to the invention, this example being given purely by way of illustrative and non limiting example, in conjunction with the annexed drawing, in which.

The present invention proceeds from the general inventive idea which consists in providing a date mechanism for a timepiece including, on the one hand, a drive wheel making one revolution every twenty-four hours and driving the date rings by acting on their teeth, and on the other hand, a correction device for quickly altering the indications provided by the date mechanism. In order to achieve this result, the date rings each include two inner peripheral toothings, one of which is for cooperating with the drive wheel, whereas the other cooperates with the correction device. Moreover, one location of each of said toothings is tooth free in order to define an extended rest position of the ring concerned. More specifically, when a ring has its free position (aperture for the upper ring and sector free of markings for the lower ring) at the watch display location, the drive wheel and the correction device are located opposite the tooth free location of the toothings of the ring concerned. Consequently, the ring concerned is in its rest position, and the correction device can only act on the other ring, thus preventing any risk of the date mechanism being disturbed. Furthermore, it is also a general object of the present invention to provide a date mechanism of the type described above wherein the jumper-effect stopping device includes two compact jumpers, easy to manufacture and guaranteeing proper positioning of the date rings. This result is achieved owing to the fact that, unlike the prior art, where because of the fact that one location on the toothing of each of the date rings had no tooth, the jumpers had to cooperate with three successive teeth of the toothing of each of the rings to guarantee the positioning of said jumpers even during passage of the missing tooth, according to the invention, each of the two date rings includes two stepped toothings whose teeth are superposed, the place of the missing tooth not being the same for both toothings, such that the jumpers are constantly housed between two successive teeth of one or other of the toothings of a given ring and thus remain meshed with the date ring concerned, even during passage of the missing tooth.

Figure 1:
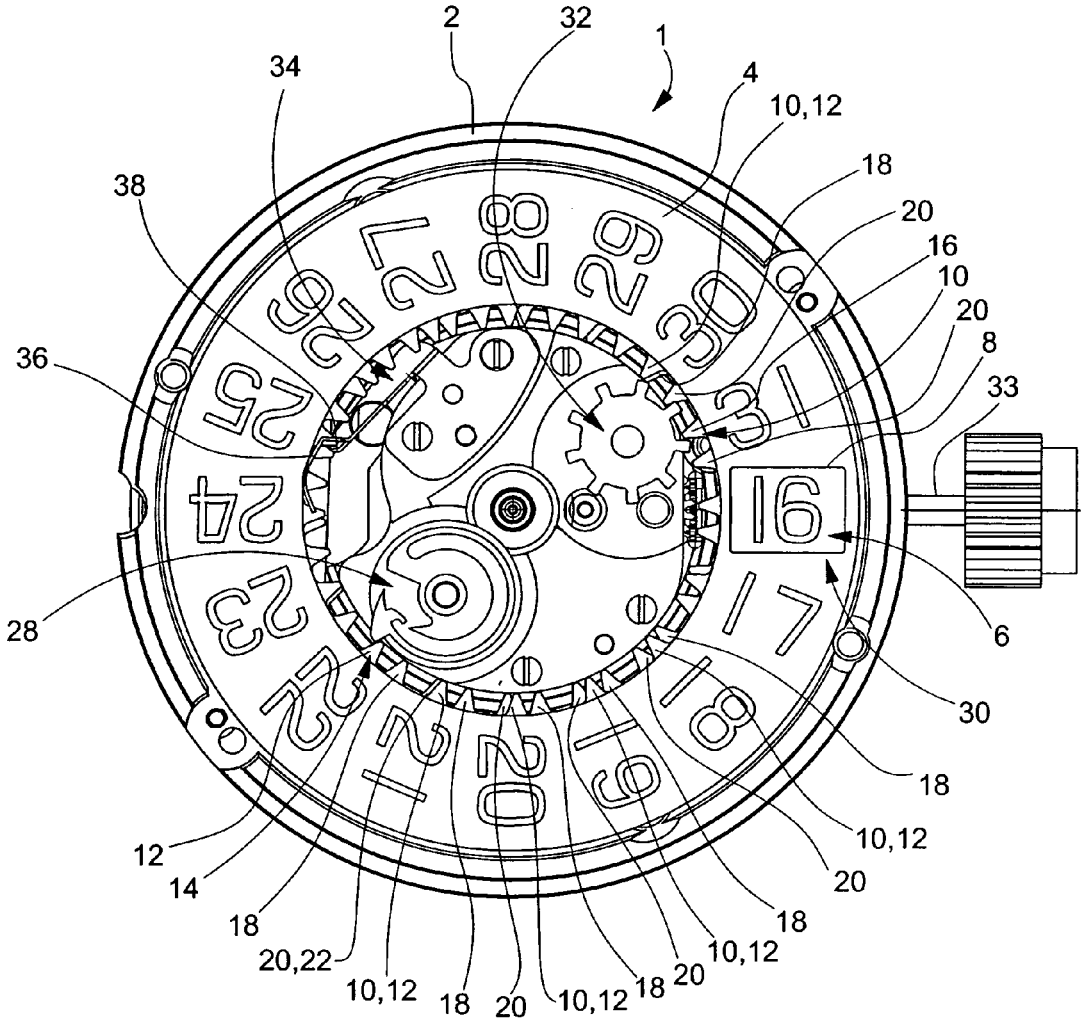
FIG. 1 is a top view of a watchcase including a date mechanism according to the invention.

FIG. 1 is a top view of a watch movement including a date mechanism in accordance with the invention. Designated as a whole by the general reference numeral 1, the movement is mounted in a plate 2. The date mechanism according to the invention mainly includes an upper date ring 4 superposed on a lower date ring 6. The upper date ring 4 includes sixteen sectors, whereas the lower date ring 6 has seventeen sectors. As can been seen upon examining FIG. 1 and even better upon examining FIGS. 4 and 5, on fifteen of its sectors, upper ring 4 bears the markings "17" to "31", whereas the last sector is provided with an aperture 8 that is open or transparent. On sixteen of its sectors, lower ring 6 includes the markings "1" to "16", whereas the last sector is free of any marking.

The inner circumference of upper date ring 4 includes a toothing formed of a succession of regularly spaced teeth. For the purposes of the description and in order to allow better comprehension of the invention, it will be assumed that this single toothing is formed of two stepped, respectively upper and lower toothings, whose teeth respectively designated 10 and 12 are superposed, one location 14 of the upper toothing and one location 16 of the lower toothing being tooth free (see FIG. 4).

Figure 5:
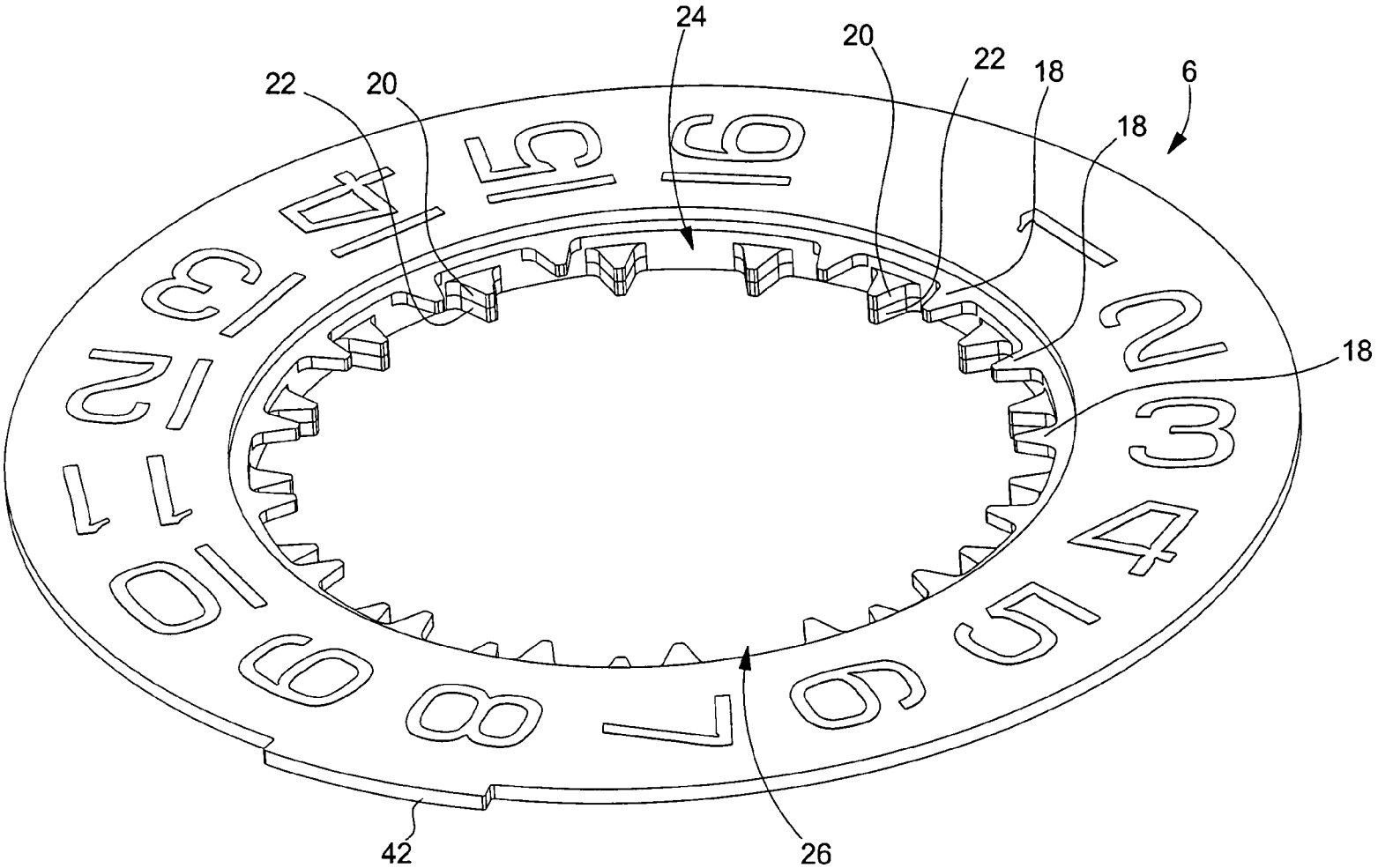
FIG. 5 is a perspective view of the lower date ring.
Figure 6:
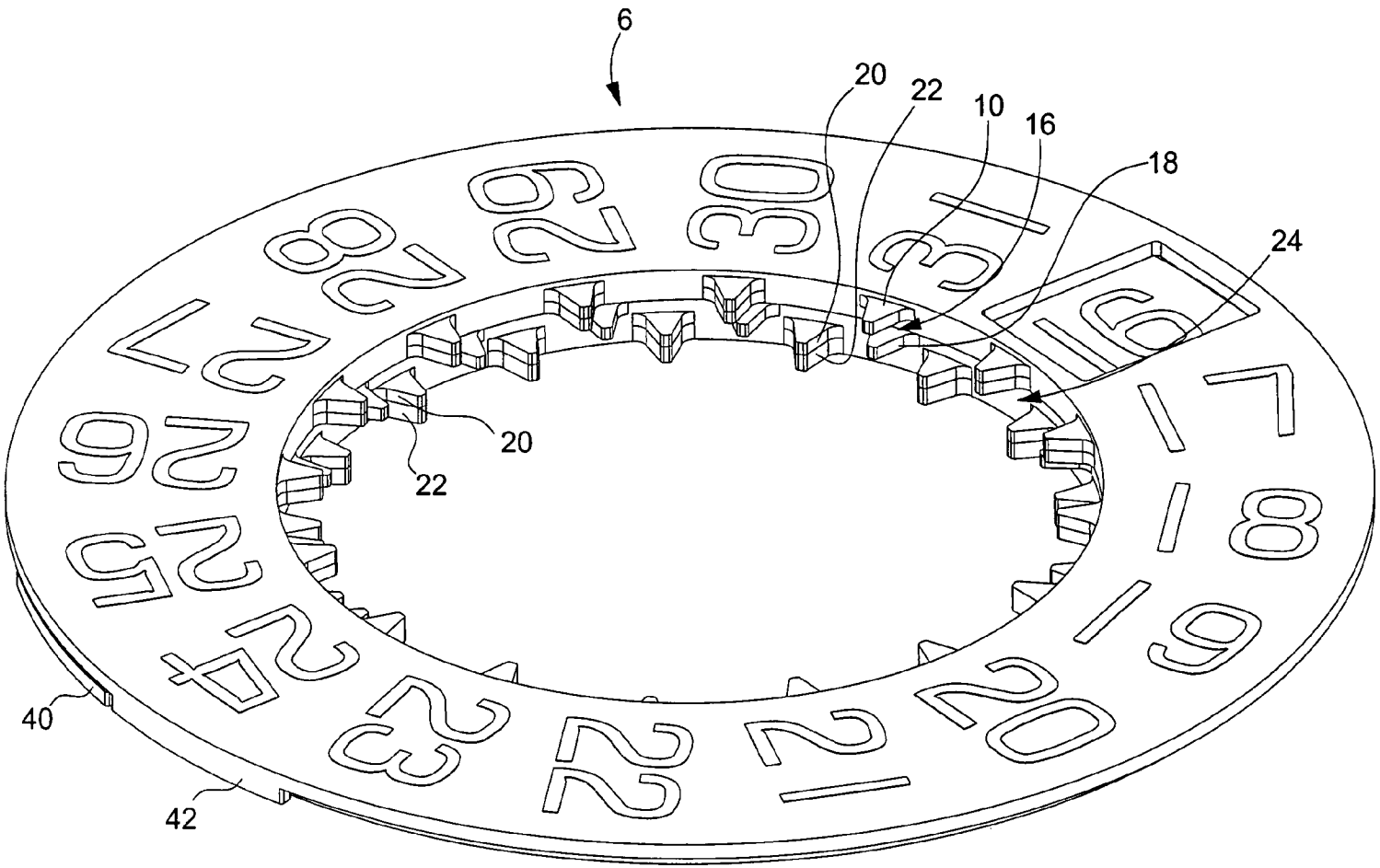
FIG. 6 is a similar view to that of FIGS. 4 and 5, the date rings being superposed.

Likewise, the inner circumference of the lower date ring 6 includes two peripheral toothings each made of a succession of regularly spaced teeth, these peripheral toothings extending along two stepped, respectively upper and lower, rows, the teeth 18 of the upper row being staggered with respect to the teeth 20 of the lower row (see FIG. 5). For the same reasons as hereinbefore, it will be assumed that the toothing of the lower row is formed of two stepped lower and extra toothings whose teeth, respectively designated 20 and 22, are superposed. One location 24 of the upper toothing and one location 26 of the lower toothing are tooth free.

Figure 2:
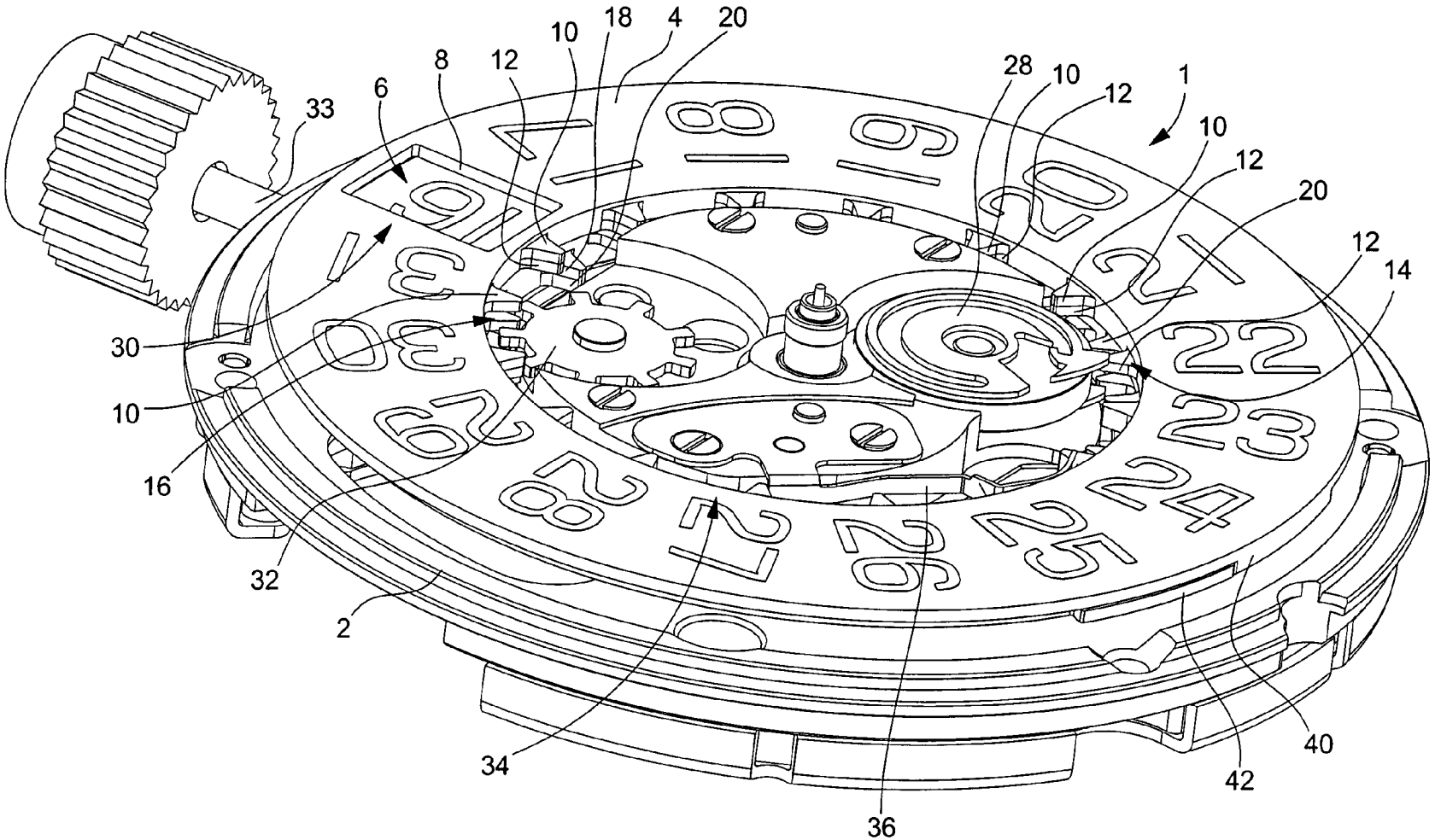
FIG. 2 is a perspective view of the watchcase of FIG. 1 from a first angle.
Figure 3:
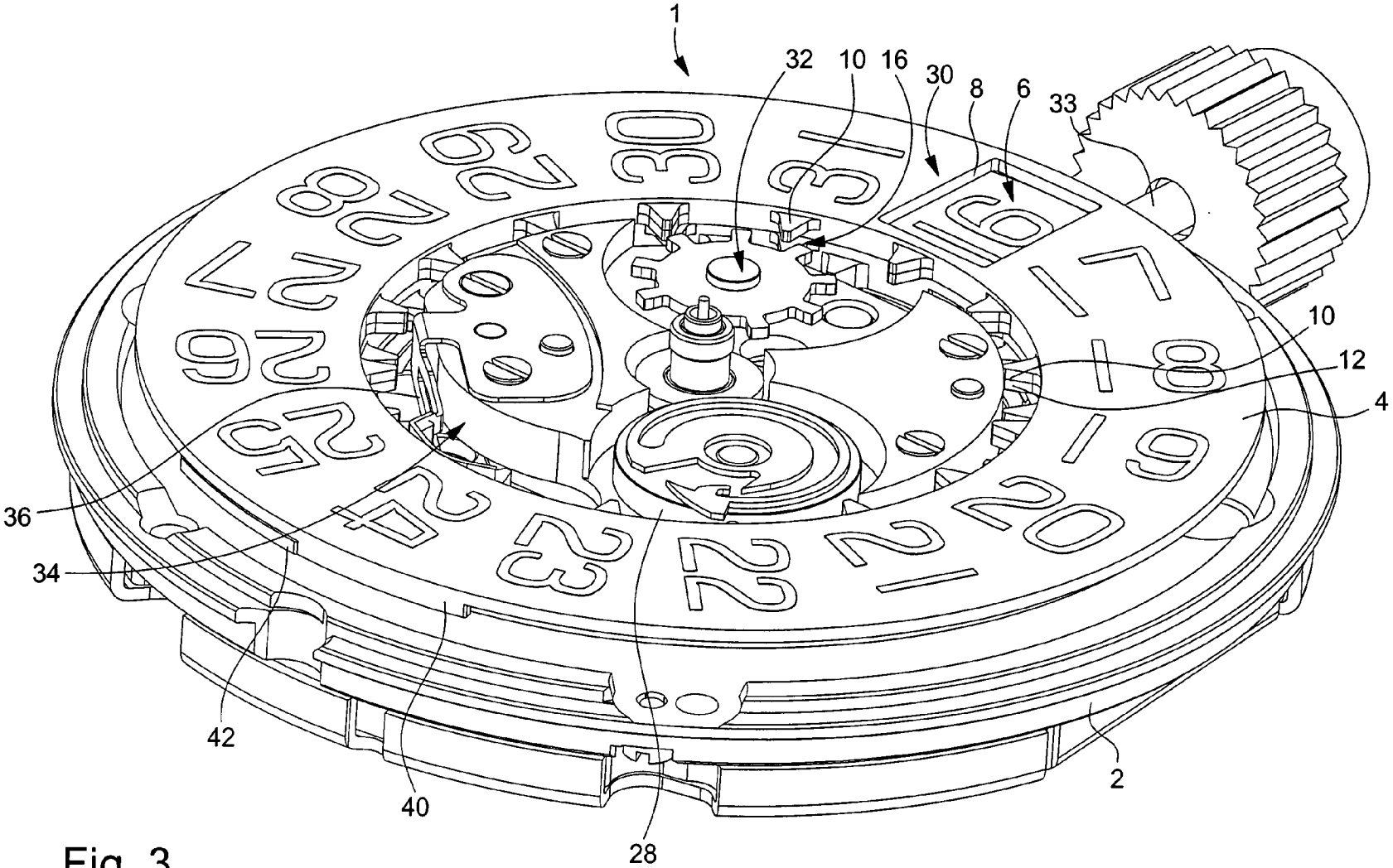
FIG. 3 is a perspective view of the watchcase of FIG. 2 from a second angle.

With reference to FIGS. 1 to 3, it can be seen that the date mechanism according to the invention includes a date drive wheel 28 making one revolution every twenty-four hours and which drives date rings 4 and 6 by acting on teeth 10 and 20 of the upper toothing of said upper ring 4 and of the lower toothing of said lower ring 6. The position of drive wheel 28 with respect to the respectively upper and lower toothings of upper ring 4 and lower ring 6 is such that, when one of these rings has its free position (aperture 8 for upper ring 4 and marking free sector for lower ring 6) at display location 30 of watch movement 1 (aperture of the dial, which would occupy the position of the figure "16", assumed to be removed), drive wheel 28 is opposite the missing tooth, respectively 14 or 26, of the upper toothing of upper ring 4, or the lower toothing of lower ring 6.

The date mechanism according to the invention also includes a correction device for quickly altering the indication provided by said date mechanism. According to a preferred embodiment of the invention, this correction device includes a sliding pinion 32. This sliding pinion 32 is actuated by the user by means of a correction stem 33 and drives date rings 4 and 6 by acting on teeth 12 and 18 of the lower toothing of said upper ring 4 and of the upper toothing of said lower ring 6. The position of sliding pinion 32 with respect to the respectively lower and upper toothings of upper ring 4 and lower ring 6 is such that, when one of the rings has its free position at display location 30 of the watch movement, sliding pinion 32 is opposite the missing tooth, respectively 16 or 24, of the lower toothing of upper ring 4 or the upper toothing of lower ring 6.

A jumper-effect stopping device 34 includes two jumpers 36 and 38, which cooperate respectively with teeth 10, 12 of the upper and lower toothings of upper ring 4 and with teeth 20, 22 of the lower and extra toothings of lower ring 6. Unlike the prior art where, because one location of the toothing of each of the date rings has no tooth, the jumpers have to cooperate with three successive teeth of each of the rings to guarantee the proper positioning of said rings even during passage of the missing tooth, jumpers 36 and 38 according to the invention are constantly housed between two immediately successive teeth of one or other of the toothings of a given ring, such that they remain meshed with the date ring concerned even during passage of the missing tooth.

Figure 4:
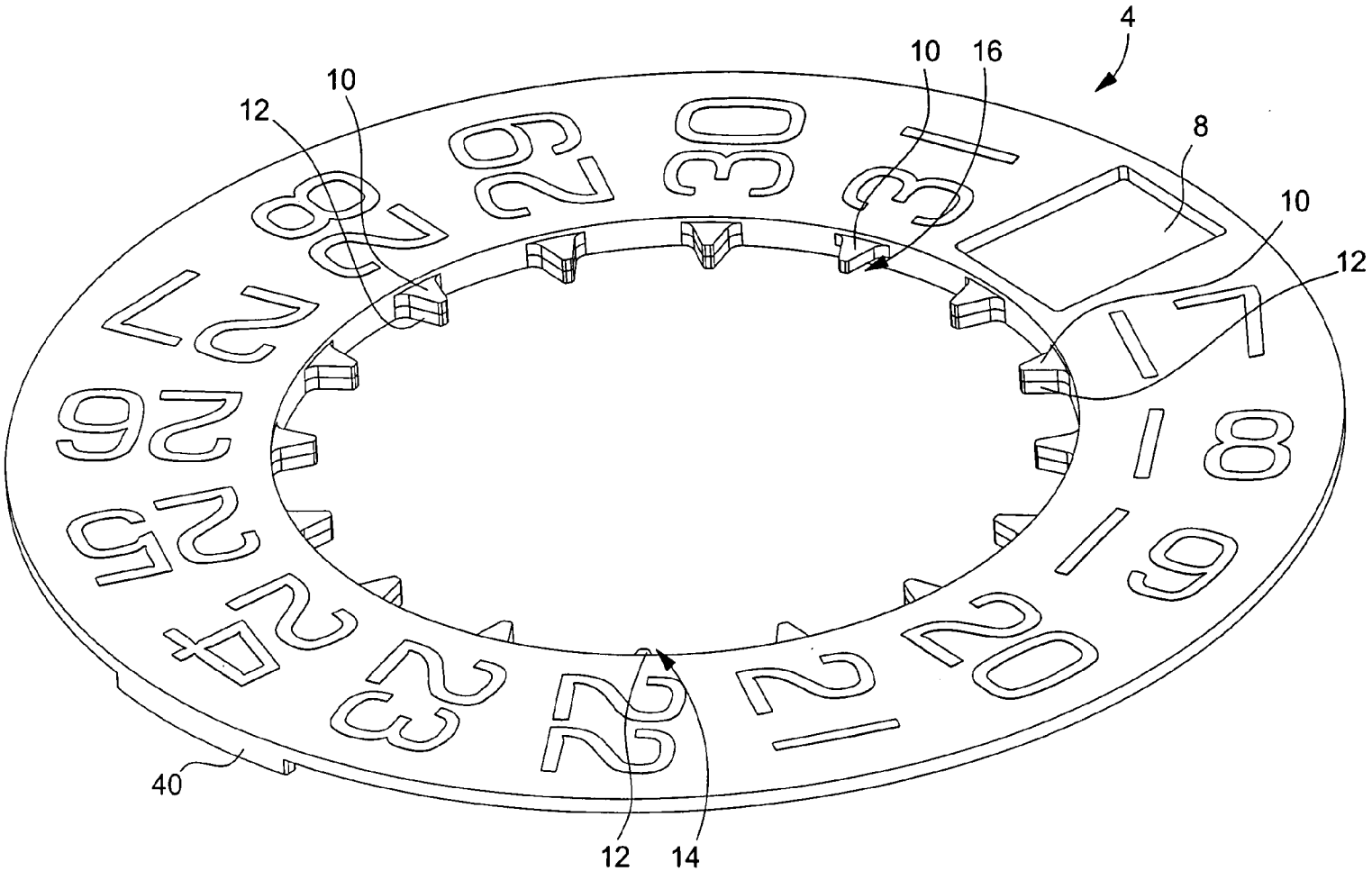
FIG. 4 is a perspective view of the upper date ring.

On their external circumference, date rings 4 and 6 each have a limit stop, respectively 40 and 42. FIGS. 4 and 5 show the detail of this arrangement. Limit stop 40 extends perpendicularly to the plane of upper date ring 4, whereas limit stop 42 extends radially outside the external perimeter of lower date ring 6.

In the situation shown in FIGS. 1 to 3, upper date ring 4 has its aperture 8 at the display location 30 and simultaneously its missing teeth 14 and 16 respectively opposite the drive wheel 28 and sliding pinion 32. It is clear that missing teeth 14 and 16 define a rest position of upper date ring 4, in which neither drive wheel 28, nor sliding pinion 32 can act on said upper date ring 4. Drive wheel 28 thus only drives lower date ring 6, which, in order to reach the position shown, has been successively brought into the situations where it revealed the markings "11", "12", . . . "15" and finally "16". At the moment when the marking "16" appears, limit stop 42 abuts against limit stop 40. At this moment, during the forward movement that will be imparted to lower ring 6 by drive wheel 28, upper ring 4 will also be driven, such that aperture 8 will disappear from display location 30 to make way for marking "17" of upper ring 4. At this moment, it will be lower ring 6 that has its missing teeth opposite, respectively drive wheel 28 and sliding pinion 32. Likewise for upper ring 4, missing teeth 24 and 26 of lower ring 6 define a rest position for said ring 6, in which neither drive wheel 28, nor sliding pinion 32 can act on said lower date ring 6. Thus, upon each revolution of drive wheel 28, only upper ring 4 will move forward one step, successively causing markings "17", "18", . . . , "30" and "31" appear. When marking "31" is displayed, the situation between the two limit stops 40 and 42 will be the reverse of that described hereinbefore, i.e. limit stop 40 of date ring 4, abutting against limit stop 42 of lower date ring 6, will simultaneously cause date ring 6 to move forward, during the forward movement of date ring 4, which will cause marking "1" to appear under aperture 8, at display location 30. During all the time that upper ring 4 was moved whereas lower ring 6 was at rest, it was the marking free sector of the latter which was opposite display location 20, this being however without any effect since, in this case, aperture 8 has never been at display location 30 and has thus never allowed lower ring 6 to be seen. Next, the sixteen markings of lower ring 6 are successively paraded, until we return to the situation shown in FIGS. 1 to 3. The cycle then starts again.

It goes without saying that the relative movement of the two upper and lower date rings 4 and 6 would be the same if they were driven not by drive wheel 28, but by sliding pinion 32 actuated by the user via the correction stem 33. The two rings 4 and 6 would simply rotate more quickly, allowing the user quickly to correct the indication provided by the date mechanism. It will be recalled that the position of sliding pinion 32 is such that, when upper ring 4 has its free position at display location 30, sliding pinion 32 is opposite missing tooth 16 of the lower toothing of upper ring 4, whereas, when lower ring 6 has its free position at display location 30, sliding pinion 32 is opposite missing tooth 24 of the upper toothing of lower ring 6. It will also be recalled that sliding pinion 32 only meshes with the toothings of the date rings when it is set in motion by the user by means of correction stem 33. During normal operation of the date mechanism, sliding pinion 32 occupies a position separate from date rings 4 and 6. Finally, it will be noted that drive wheel 28 drives date rings 4 and 6 via a finger having a certain elasticity, such that when one of rings 4 or 6 is driven by sliding pinion 32, the finger disappears in front of the tooth which is passing it and falls into the hollow defined by said tooth and the following tooth.

Figure 7:
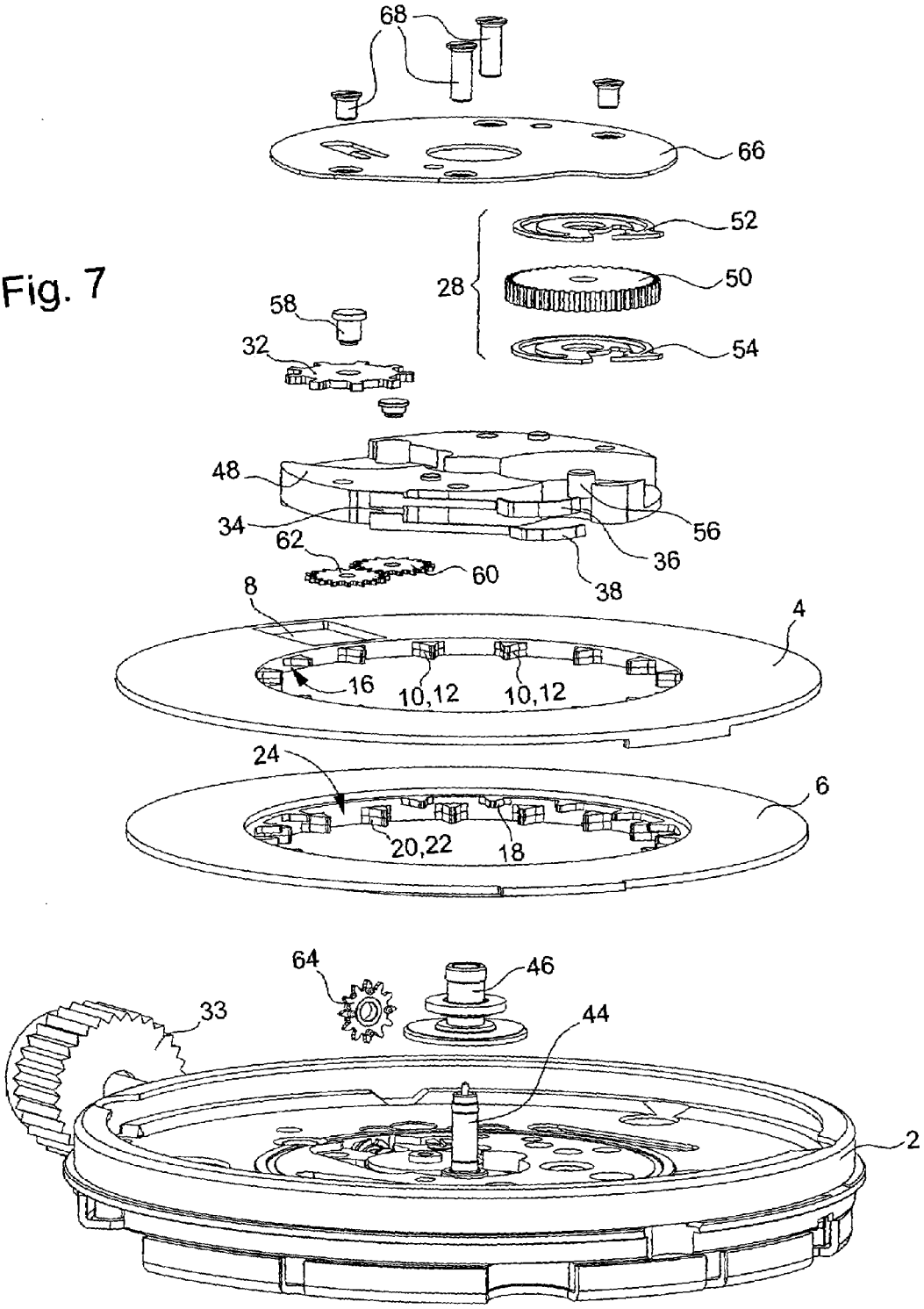
FIG. 7 is an exploded view of the date mechanism.

FIG. 7 is an exploded view of watch movement 1 provided with the date mechanism according to the invention. This movement 1 includes a plate 2, which supports and guides in rotation the two lower and upper date rings 6 and 4. At the centre of plate 2, in a conventional manner, stands the hour wheel arbour 44 on which the hour wheel 46 is engaged. A bridge 48 carries stopping device 34 provided with its two jumpers 36 and 38 which respectively act on upper date ring 4 and lower date ring 6. Drive wheel 28 includes a wheel 50 driven, via a reducer wheel set that is not shown, by hour wheel 46 so as to complete one revolution in twenty-four hours. Two fingers 52 and 54 are fixed, for example by welding, onto wheel 50. These two fingers 52 and 54 drive the respectively upper 4 and lower 6 date rings, by acting on the upper toothing of said upper ring 4 and on the lower toothing of said lower ring 6. If the missing tooth 14 of the upper toothing of upper date ring 4 is located opposite drive wheel 28, the latter will have no effect on said upper ring 4 and will drive lower date ring 6, via its finger 54, through one step each day. Conversely, if missing tooth 26 of the lower toothing of lower date ring 6 is located opposite drive wheel 28, finger 54 will not be able to mesh with teeth 20 of said lower ring 6 and only upper ring 4 will move forward one step each day.

Drive wheel 28 is freely mounted on an arbour 56 of bridge 48. Likewise, sliding pinion 32 is mounted on bridge 48 via an arbour 58. Said sliding pinion 32 is connected to correction stem 33 by a kinematic chain including intermediate wheels 60 and 62 and a pinion 64. Finally, the date mechanism according to the invention is held axially on plate 2 by means of a holding plate 66 fixed using screws 68.

Figure 8:
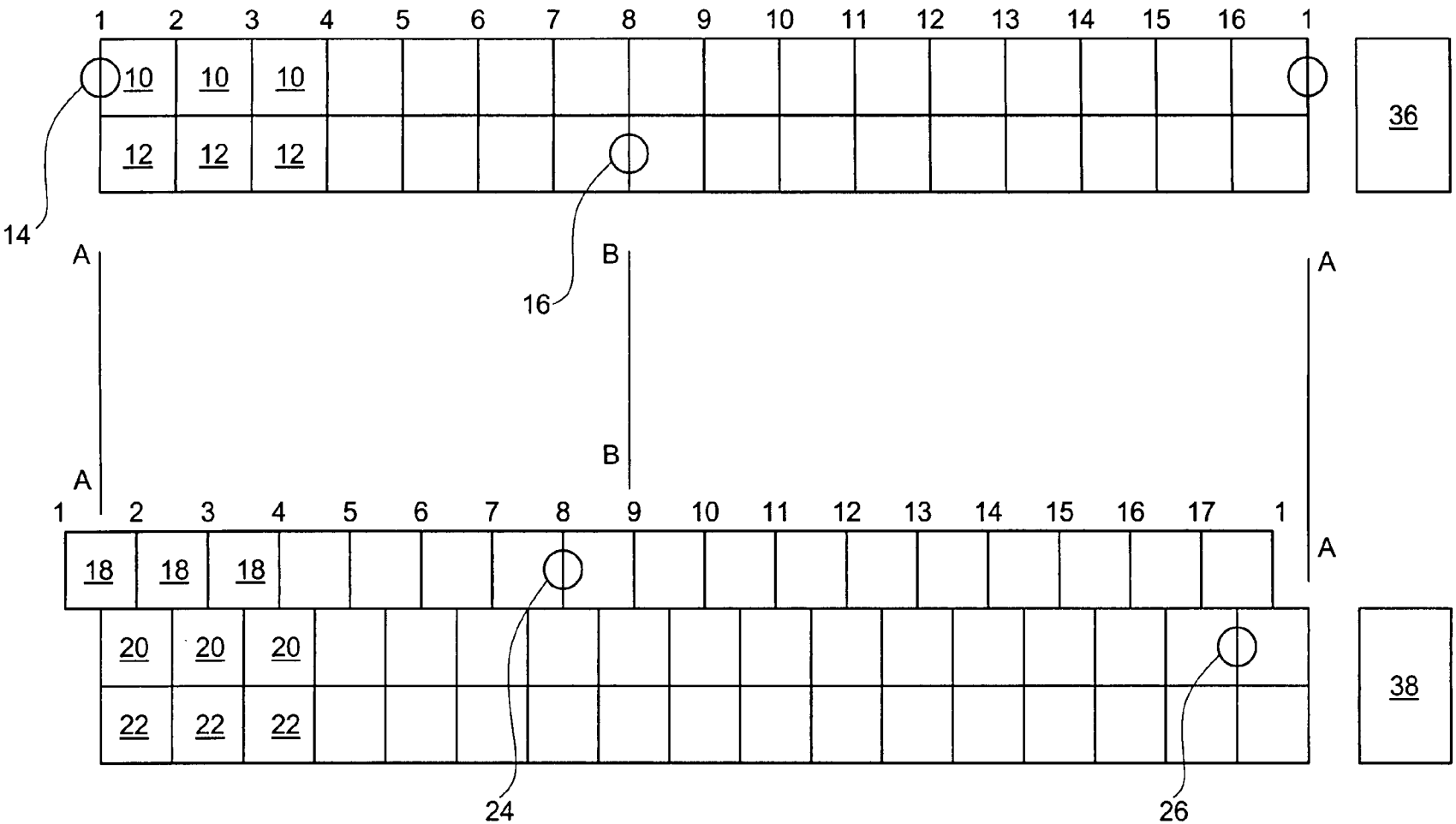
FIG. 8 is an expanded schematic diagram of the peripheral toothings of the lower and upper date rings.

FIG. 8 is an expanded diagram of the toothings of upper and lower date rings 4 and 6. As can be seen upon examining this Figure, upper date ring 4 includes sixteen teeth identified by the figures 1, 2, . . . , 15 and 16, whereas lower date ring 6 includes seventeen teeth identified by the numbers 1, 2, . . . , 16 and 17. Upper ring 4 thus includes 16 divisions, whereas the lower ring includes 17 divisions.

Upper date ring 4 includes two stepped toothings, whose teeth, respectively designated 10 and 12, are superposed, one location 14 of the upper toothing and one location 16 of the lower toothing, each identified by a circle in a full line, being tooth free.

Upper date ring 6 also includes two stepped toothings, whose teeth, respectively designated 18 and 20, are staggered, one location 24 of the upper toothing and one location 26 of the lower toothing, each identified by a circle in a full line, being tooth free. Lower date ring 6 also includes an additional toothing whose teeth 22 coincide with teeth 20 of the lower toothing.

The position of drive wheel 28 and that of sliding pinion 32 opposite the toothings of upper and lower date rings 4 and 6 are identified by the straight line segments A—A and B—B respectively. Finally, the two jumpers 36 and 38 are represented by two rectangles, which carry the same reference numerals. As can be seen upon examining the drawing, the height of the two jumpers 36 and 38 is equal to the thickness of the upper and lower toothings, respectively the lower and additional toothings, of upper date ring 4 and lower date ring 6 with which said jumpers cooperate.

In the situation shown in FIG. 8, upper date ring 4 has its two missing teeth 14 and 16, respectively opposite drive wheel 28 and sliding pinion 32. This position corresponds to the situation in which upper ring 4 has its aperture 8 at display location 30 of the movement and reveals the number "16" borne by lower ring 6. At the moment when the marking "16" appears, limit stop 42 of lower ring 6 abuts against limit stop 40 of upper ring 4. Thus when lower ring 6 is moved forward by driving wheel 28, upper ring 4 will also be driven. It is then lower ring 6 which will have its missing teeth 24 and 26 opposite, respectively, drive wheel 28 and sliding pinion 32, whereas the missing teeth 14 and 16 of upper ring 4 will have moved forward one step.

As already mentioned hereinbefore, the height of the two jumpers 36 and 38 is substantially equal to the thickness of teeth 10, 12 and 20, 22 such that during the passage of the missing teeth, said jumpers still remain engaged between two immediately consecutive teeth of the toothings of the upper and lower discs, guaranteeing proper positioning of said discs.

It goes without saying that the present invention is not limited to the embodiment that has just been described, and that various simple modifications and variants can be envisaged by those skilled in the art without departing from the scope of the present invention. In particular, the upper date ring could include seventeen sectors, while the lower date ring could have only sixteen.

What is claimed is:

1. A date mechanism for a timepiece such as a wristwatch including two superposed respectively upper and lower date rings, whose surface is divided into a plurality of sectors, the upper ring including sixteen sectors, fifteen of which respectively bear fifteen successive markings of a cycle of 31 positions, and the sixteenth of which is an extra sector having an open or transparent aperture, whereas the lower ring includes seventeen sectors, sixteen of which bear respectively the other sixteen markings of the cycle of 31 positions, and the seventeenth of which is an extra sector, each of said rings cooperating with drive means such that the markings of the lower ring appear successively in a display zone through the aperture, the upper ring remaining immobile, and that the lower ring being immobile, the markings of upper ring appear successively in the display zone, the upper ring concealing the markings of the lower ring, the date mechanism being wherein each ring includes two peripheral toothings each made of a succession of regularly spaced teeth, these peripheral toothings extending along two stepped, respectively upper and lower rows, the teeth of the upper and lower rows of the upper ring being superposed, whereas the teeth of the upper and lower rows of the lower ring are staggered, one location of each of the toothings of the upper and lower rings being tooth free, and wherein said date mechanism further includes a correction device for altering the indication provided by the date mechanism, the position of the drive means with respect to the upper and lower toothings of the respectively upper and lower rings, and the position of the correction mechanism with respect to the lower and upper toothings of the respectively upper and lower rings being such that when the upper ring has its extra sector at the location of said display zone, the drive means and the correction device are located respectively opposite the tooth free location of the toothing of the upper row and that of the lower row of the upper ring, and when the lower ring has its extra sector at the location of said display zone, the drive means and the quick correction device are located respectively opposite the tooth free location of the toothing of the lower row and that of the upper row of the lower ring.

2. The date mechanism according to claim 1, wherein the correction device includes a sliding pinion which only meshes with the lower and upper toothings of the respectively upper and lower date rings when it is set in motion by means of a correction stem.

3. The date mechanism according to claim 1, wherein it includes jumper-effect stopping means which cooperate with the upper and lower toothings of the upper ring, and with the lower toothing of the lower ring as well as with an additional toothing located under the lower toothing of said lower ring and whose teeth are arranged to coincide with those of said lower toothing.

4. The date mechanism according to claim 2, wherein it includes jumper-effect stopping means which cooperate with the upper and lower toothings of the upper ring, and with the lower toothing of the lower ring as well as with an additional toothing located under the lower toothing of said lower ring and whose teeth are arranged to coincide with those of said lower toothing.

5. The date mechanism according to claim 3, wherein the stopping means include two jumpers the height of which is substantially equal to the thickness of the teeth.

6. The date mechanism according to claim 4, wherein the stopping means include two jumpers the height of which is substantially equal to the thickness of the teeth.

7. The date mechanism according to claim 1, wherein the drive means include a wheel which makes one revolution in 24 hours and which is fitted with two fingers which respectively drive the upper and lower date rings by acting on their respective teeth.

* * * * *